United States Patent [19]

Puchy

[11] 4,185,367

[45] Jan. 29, 1980

[54] INTER-ENGAGING UPHOLSTERY BUTTON ANCHORS

[76] Inventor: David P. W. Puchy, P.O. Box 382, Cheltenham, New South Wales 2119, Australia

[21] Appl. No.: 887,568

[22] Filed: Mar. 17, 1978

[51] Int. Cl.[2] ..... B68G 7/12; B68G 7/08

[52] U.S. Cl. ..... 29/91.1; 28/147; 29/91.4

[58] Field of Search ..... 29/91, 91.1, 91.3, 91.4, 29/243.5, 243.57; 24/90 R, 90 B; 28/2

[56] References Cited

U.S. PATENT DOCUMENTS

| | | | |
|---|---|---|---|
| 636,877 | 11/1899 | Wersel, Jr. | 29/91.3 |
| 661,302 | 11/1900 | Bernhardt et al. | 29/91.4 |
| 776,055 | 11/1904 | Grosjean et al. | 29/91.3 |
| 1,220,237 | 3/1917 | Kenyon | 29/91.3 |

FOREIGN PATENT DOCUMENTS

| | | | |
|---|---|---|---|
| 1126177 | 3/1962 | Fed. Rep. of Germany | 24/90 B |
| 725425 | 3/1955 | United Kingdom | 29/91.1 |

*Primary Examiner*—Horace M. Culver

*Attorney, Agent, or Firm*—Seidel, Gonda, Goldhammer & Panitch

[57] ABSTRACT

The present invention discloses an upholstery fastener, a method of interengaging two such fasteners, and an insertion tool capable of such interengagement.

Preferably the fastener takes the form of a button-like body having a thread or shank extending therefrom with an arrow-shaped head at the free end of the thread. The head includes an opening able to engage with the barbs of the head of a like fastener. The fastener is preferably moulded from plastics.

An insertion tool to enable two such fasteners to be inserted, one from either side of a cushion, and thereby interengaged to quilt the cushion, is also disclosed.

3 Claims, 5 Drawing Figures

FIG. 4

INTER-ENGAGING UPHOLSTERY BUTTON ANCHORS

The present invention relates to an improvement in the upholstery fastener disclosed in Australian Patent Application No. 24696/77 (PC5940), U.K. Application No. 18078/77, U.S. Application No. 793,811 (now abandoned) or German Patent Application No. P2721732.9 all to the same applicant.

That application disclosed an upholstery fastener having a head, a flexible shank or thread and a deformable securing means at the free end of the thread. The securing means was preferably formed from an inverted v-shaped piece of plastics material thereby creating an integral arrow head at the free end of the thread.

This upholstery fastener was suitable for use where the material to be upholstered was backed by a relatively rigid member such as a sheet of particle board. Accordingly the abovementioned upholstery fastener could not be used to provide two opposed buttons, one located on the exterior of either side of a cushion, for example.

It is the object of the present invention to provide an upholstery fastener which, when inserted from one side of a cushion, for example, is adapted to interengage with a like fastener inserted from the other side of the cushion, thereby providing the desired quilting or compression.

In accordnce with one aspect of the present invention there is disclosed an upholstery fastener having a body, a shank or thread extending from said body and having a head at its free end, said head having an opening therein adapted to receive the head of a like fastener, and being shaped to interengage with said received head.

According to another aspect of the present invention there is disclosed a method of engaging two of the abovementioned fasteners, said method comprising the steps of passing hook means through the opening in the head of one said fastener and through said material so as to position said one fastener adjacent one side of said piece of material and compress said piece of material; maintaining said piece of material compressed whilst engaging the head of the other fastener with said hook means; moving said hook means back through said material from the other side thereof and through the opening in the head of said one fastener to interengage the heads of said fasteners and position the body of said other fastener adjacent said other side; disengaging said hook means from the head of said other fastener; and releasing said piece of material from said compression thereby causing the resilience of said material to position said interengaged heads within said material and maintain said heads interengaged.

According to a still further aspect of the present invention there is disclosed an insertion tool for use in carrying out the above method, said tool comprising a shaft having handle means at one end thereof and hook means at the other end thereof; and a collar slidable along said shaft, said collar having a hollow sleeve extending therefrom towards said hook means and slidable with said collar.

One preferred embodiment of the present invention will now be described with reference to the drawings in which.

Figures 1, 2, 3, 4, 5:
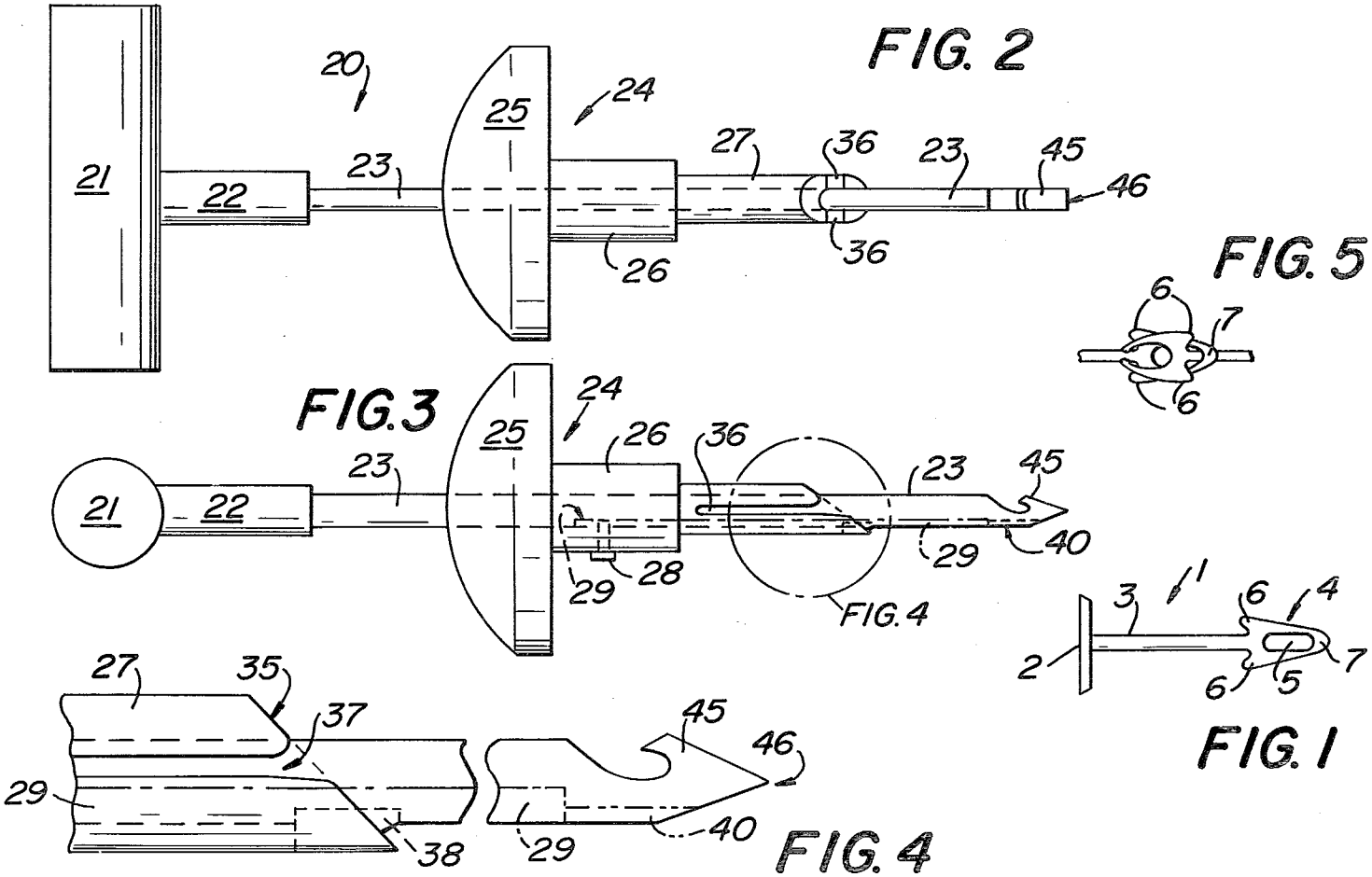
FIG. 1 is a side view of the upholstery fastener of the preferred embodiment.
FIG. 2 is a plan view of the insertion tool of the preferred embodiment.
FIG. 3 is an elevation of the insertion tool of FIG. 2.
FIG. 4 is a detailed magnified view of part of FIG. 3.
FIG. 5 is a schematic view of two interlocked fastener heads.

Referring now to FIG. 1, the upholstery fastener 1 of the preferred embodiment comprises a body 2 which may be of any shape but preferably comprises a flat disc which may be covered with fabric in conventional manner to form the visible portion of an upholstery button. A thin flexible shank or thread 3 extends from the body 1 and terminates in an arrow shaped head 4 having an aperture 5, two barbs 6 and a narrow point 7.

The thread 3 and head 4 are substantially flat and co-planar, lying in the plane of the paper. The fastener 1 is preferably moulded from plastics material such as nylon including a predetermined percentage of glass filling.

The insertion tool 20 of the preferred embodiment illustrated in FIGS. 2 to 4 comprises a cylindrical handle 21 having a shank 22 perpendicular thereto. A thin elongated shaft 23 extends from the shank 22 and has a collar 24 slidably mounted thereon. The collar 24 comprises a quasihemishperical butt 25 to which are secured a barrel 26 and sleeve 27. A grub screw 28 (FIG. 3) passes through the barrel 26 and protrudes into a first keyway 29 extending along the shaft 23. The grub screw 28 and first keyway 29 combine to prevent the collar 24 from rotating relative to the shaft 23 and also limit the length of stroke of the collar 24 along the shaft 23.

The free end of the sleeve 27 is cut obliquely to the longitudinal axis of the sleeve 27 to form an inclined surface 35 (FIG. 4). Two slots 36 extend one along each side of the sleeve 27. Each slot extends right through the sleeve 27 to expose the shaft 23. Each slot 36 has a bell-mouthed opening 37 facing the inclined surface 35.

A key 38 is mounted in the sleeve 27 so that part of the key 38 protrudes beyond the inclined surface 35. The key 38 slides within a second keyway 40 in the shaft 23 only when the collar 24 is furthest from the handle 21. The free end of the shaft 23 is formed into a hook 45 having a knife edge 46. The operations required to insert a fastening device as illustrated in FIG. 1 into each side of a cushion, for example, to form two opposed upholstery buttons and compress the material of the interior of the cushion, will now be described.

First the collar 24 of the tool 20 is slid along the shaft 23 towards the handle 21. Then the hook 45 is passed through the aperture 5 of a first fastener and the head 4 of the first fastener thereby threaded onto the shaft 23 with the body 2 of the first fastener on the opposite side of the collar 24 to that of the grub screw 28.

The knife edge 46 and part of the shaft 23 are then passed through one (first) side of the cushion and right through the cushion so that the hook 45 protrudes through the other (second) side of the cushion. This leaves the first fastener positioned on the shaft 23 between the collar 24 and the first side of the cushion.

Then the hook 45 is engaged with the narrow point 7 of the head 4 of the second fastener. Next the handle 21 of the tool 20 is pulled away from the cushion thereby pulling the head 4 of the second fastener into the interior of the cushion and forcing the body 2 of the second fastener against the second side of the cushion.

With the relative position of the shaft 23 and cushion maintained, the collar 24 is slid along the shaft 23 towards the first side of the cushion thereby engaging the narrow point 7 of the first fastener with the key 38. In this way the head 4 of the first fastener is moved against the first surface of the cushion.

The handle 21 and collar 24 are then moved away from each other causing the hook 45 to carry the narrow point 7 of the head 4 of the second fastener, through the aperture 5 of the first fastener and into the slot 36. Continued relative movement between the shaft 23 and collar 24 carries the head 4, including barbs 6, of the second fastener right through the aperture 5 of the first fastener. In this way the heads 4 of both fasteners are interengaged.

Finally the hook 45 is moved past the end of the slots 36 thereby severing the narrow point 7 of the head 4 of the second fastener. Once this has occured the tool 20 is able to be disengaged from both fasteners and pulled from the cushion. However, the interengaged heads 4 of both fasteners are now located within the interior of the cushion.

As seen in FIG. 5, the barbs 6 of the second fastener (on the right) engage with the narrow point 7 of the first fastener (on the left) to lock both fasteners together. Because of the natural resiliency of the material of the interior of the cushion, the heads 4 are maintained under tension, since the total length of the two threads 3 is selected to be less than the uncompressed thickness of the cushion. The degree of compression or quilting of the cushion is adjustable by selecting different total lengths for the two threads 3.

In the upholstery of furniture having a frame, it has hitherto been the practice when locating a button on the upholstery, to pass a fabric thread from the button directly through the upholstery and then through the webbing stretched over the frame.

Then the fabric thread is tensioned to the desired degree by pulling the portion of fabric thread extending beyond the webbing and then securing the free end of the thread to the frame.

This method of construction places great strain on the webbing which eventually distorts, thereby upsetting the original tensioning. In addition, the movement between the webbing and the fabric thread caused by use of the furniture, causes the fabric thread to wear and eventually break. As a result the button comes away from the furniture leaving an unsightly hole in the fabric.

These problems are overcome by the present invention by inserting two fasteners into the upholstery from opposite sides, one of the fasteners passing directly through the webbing. Since the body 2 of this fastener bears directly against the webbing there is no distortion of the webbing. Also the threads 3 of the fasteners 1, being preferably made of plastics material such as nylon, are virtually unbreakable.

The foregoing describes only one embodiment of the present invention and modifications, obvious to those skilled in the art, may be made thereto without departing from the present invention. For example the fasteners 1 preferably have threads 3 of identical length, for ease of moulding, but may have different lengths if desired. In addition the exterior surface of the body 2 may be patterned or grooved and suitably coloured instead of being cloth covered.

What I claim is:

1. A method of inter-engaging two upholstery fasteners so as to compress a piece of resilient material having two opposite sides, said fasteners each having a body, a shank extending from said body and a head at the free end of said shank, said head having an opening therein adapted to receive the head of a like fastener and being shaped to inter-engage said received head, said method comprising the steps of passing hook means through the opening in the head of one said fastener and through said material so as to position said one fastener adjacent one side of said piece of material and compress said piece of material; maintaining said piece of material compressed while engaging the head of the other fastener with said hook means; moving said hook means back through said material from the other side thereof an through the opening in the head of said one fastener to inter-engage the heads of said fasteners and position the body of said other fastener adjacent said other side; dis-engaging said hook means from the head of said other fastener; and releasing said piece of material from said compression thereby causing the resilience of said material to position said inter-engaged heads within said material and maintain said heads inter-engaged.

2. The method as claimed in claim 1 wherein said hook means is dis-engaged from the head of said other fastener by cutting the head of said other fastener.

3. The method as claimed in claim 1 wherein the length of the shank of each said fastener is selected to produce the required degree of quilting of said material.

* * * * *